US006170089B1

(12) United States Patent
Marchetti

(10) Patent No.: US 6,170,089 B1
(45) Date of Patent: Jan. 9, 2001

(54) ARTICLE SUCH AS A STOCKING OR PAIR OF TIGHTS (PANTY-HOSE) MADE FROM SHEER KNIT FABRIC, WITH THIN, FLAT SEAMS

(75) Inventor: Luigi Marchetti, Castiglione delle Stiviere (IT)

(73) Assignee: Golden Lady S.p.A. (IT)

( * ) Notice: Under 35 U.S.C. 154(b), the term of this patent shall be extended for 0 days.

(21) Appl. No.: 09/214,463

(22) PCT Filed: Apr. 9, 1997

(86) PCT No.: PCT/IT97/00075

§ 371 Date: May 26, 1999

§ 102(e) Date: May 26, 1999

(87) PCT Pub. No.: WO98/00595

PCT Pub. Date: Jan. 8, 1998

(30) Foreign Application Priority Data

Jun. 28, 1996 (IT) ..... FI96A0158
Nov. 27, 1996 (IT) ..... FI9600141 U

(51) Int. Cl.[7] ..... A41D 27/24; A41B 11/01
(52) U.S. Cl. ..... 2/275; 2/239; 66/179
(58) Field of Search ..... 66/179; 2/275; 112/438, 440, 441, 415, 475.12, 470.15, 162, 165, 197

(56) References Cited

U.S. PATENT DOCUMENTS

| | | | | |
|---|---|---|---|---|
| 1,934,328 | * | 11/1933 | Rubel | 2/275 |
| 1,968,967 | * | 8/1934 | Snader | 2/239 |
| 2,164,036 | * | 6/1939 | Lane | 2/275 |
| 2,512,489 | * | 6/1950 | Dills | 2/275 |
| 2,617,114 | * | 11/1952 | Sanson | 2/275 |
| 3,082,724 | * | 3/1963 | Washburn | 2/275 |
| 4,697,440 | * | 10/1987 | Riccitelli | 66/177 |

OTHER PUBLICATIONS

Federal Standard: Stitches, seams, and stitchings, Mar. 1930, Stitch type 503, 504 and 505.*

* cited by examiner

*Primary Examiner*—John J. Calvert
*Assistant Examiner*—Alissa L. Hoey
(74) *Attorney, Agent, or Firm*—McGlew and Tuttle, P.C.

(57) ABSTRACT

The seams for joining together, along the crotch, the pieces of fabric making up the article and/or for closing the toes of the legs, are made with two needle threads (F1, F2) and one looper thread (F3) that forms a chain stitch, all of them forming long stitches, in such a way that, under the stretching of the garment as it is put on, the seams become essentially "flat", that is to say very thin and certainly much thinner than they are wide.

4 Claims, 2 Drawing Sheets

F1
F2
F3
I
T
L1
L2
C
III

ARTICLE SUCH AS A STOCKING OR PAIR OF TIGHTS (PANTY-HOSE) MADE FROM SHEER KNIT FABRIC, WITH THIN, FLAT SEAMS

FIELD OF THE INVENTION

This invention relates to an article made of sheer knit fabric, typically stockings, tights (panty-hose) and the like, the seams of which article have little thickness, unlike the seams obtainable with current well-known overlock machines such as UNION SPECIAL and so on, in which seams the margins of the pieces of fabric to be assembled are drawn tightly together ("overlock" seaming) which results in very thick, cord-like seams; this is disadvantageous both from the point of view of the comfort and "wearability" of the garment, because of the irritation caused by the shape of the seams, and from the point of view of the aesthetic appearance of the garment.

SUMMARY AND OBJECTS OF THE INVENTION

The present garment avoids these problems and has stable seaming and satisfactory appearance; it can also be produced with a high degree of automation and is therefore clearly suited to industrial application.

Fundamentally, the article, such as a stocking, pair of tights (panty-hose) or the like made from sheer knit fabric has seams for joining together, along the crotch, its constituent pieces of fabric and/or for closing the toes of the legs, whose structure is such that, under the stretching of the garment as it is put on, the seams become essentially "flat", that is to say very thin, and certainly much thinner than they are wide.

In one practical embodiment, said seams are made with two needle threads and one looper thread for the chain stitch, these together forming relatively long stitches that do not pull tight.

In the seam produced according to the invention, when the fabric pieces—joined together by said seam—are tensioned and made coplanar, their margins connected by the seam in question are effectively "edge-to-edge", that is to say "adjacent" or "juxtaposed" so that the seam becomes thin, and certainly much thinner than it is wide.

Basically, the article according to the invention comprises seams consisting of three threads forming three series of stitches, specifically:

a) a first series of short stitches, formed with a first needle thread, which extend across the "line of the cut", passing out of one of the two pieces of fabric being joined together and entering the other at positions relatively near to the cut edges;

b) a second series of longer stitches, formed with a second needle thread, which stitches also extend across the line of the cut, passing out of one of the two pieces of fabric being assembled and entering the other at a greater distance from the same line of the cut than the stitches forming the aforesaid first series of stitches, so that the shorter stitches of the first series of stitches lie inside the longer stitches of the second series of stitches; and c) a third series of stitches, formed with "slack" stitches of a looper thread, much longer and "slacker" than those of the first two series of stitches, which stitches of the third series form the "chain" seam, extending across the line of the cut and forming chain stitches with the first and second needle threads.

It follows from the structural characteristics of the seam described above that, under the stretching of the garment as it is put on, the seam becomes wider and quite flat, with virtually no overlapping of the fabric pieces. This has the obvious advantages of greater comfort and a much more pleasing appearance of the garment. There is no disadvantageous impact on either the practical or aesthetic effect from the fact that the width of the flat seam produced in this way cannot be made to equal that obtained with the type of seam produced with only manual sewing machines; because in fact, from the aesthetic point of view it is actually decidedly preferably, in tights and stockings, for the width of the seam to be limited.

The drawing shows one possible embodiment of a flat seam according to the invention, and one possible example of equipment for producing it.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
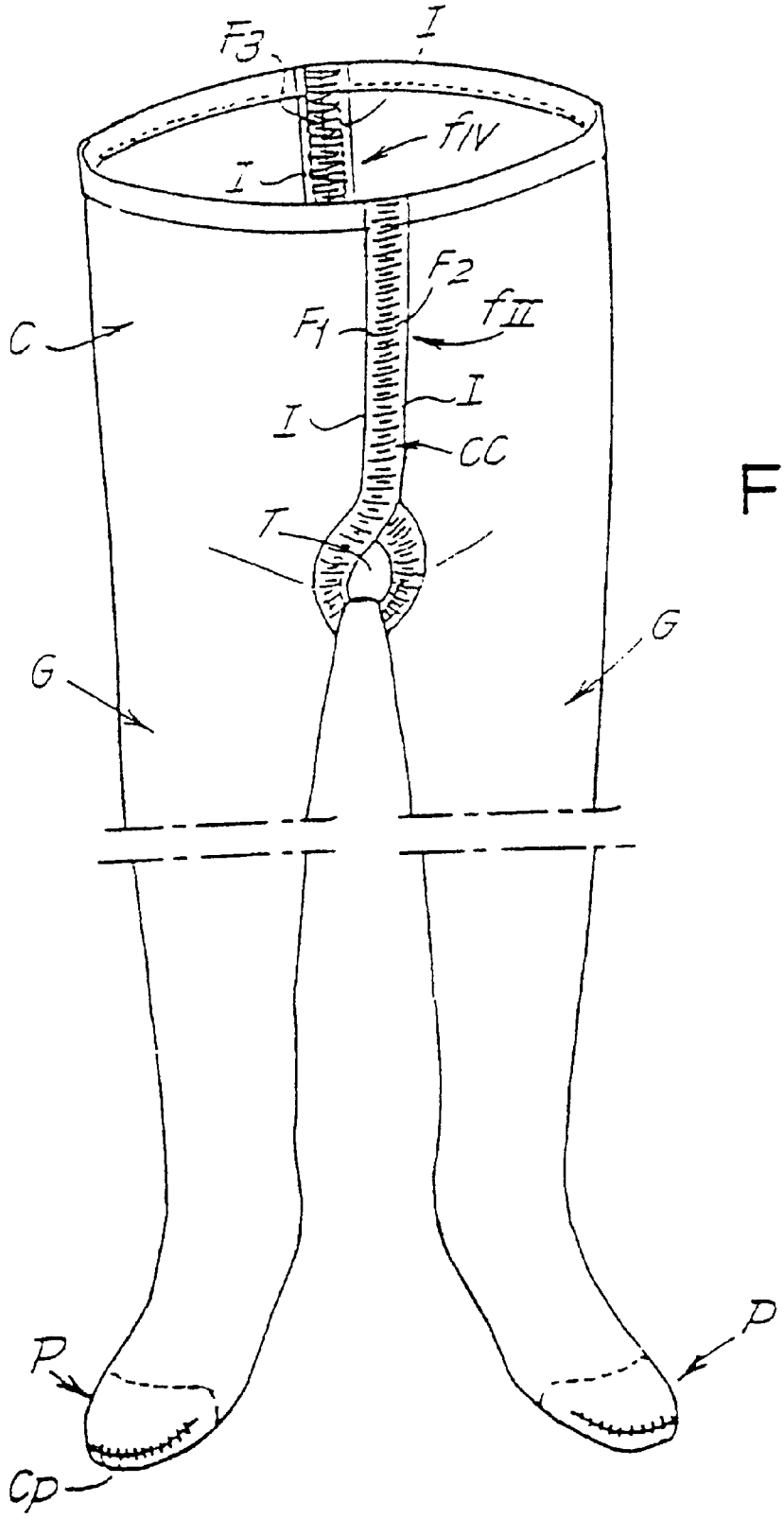
FIG. 1 shows a highly schematic perspective view of a pair of tights or panty-hose.
Figures 2, 3, 4:
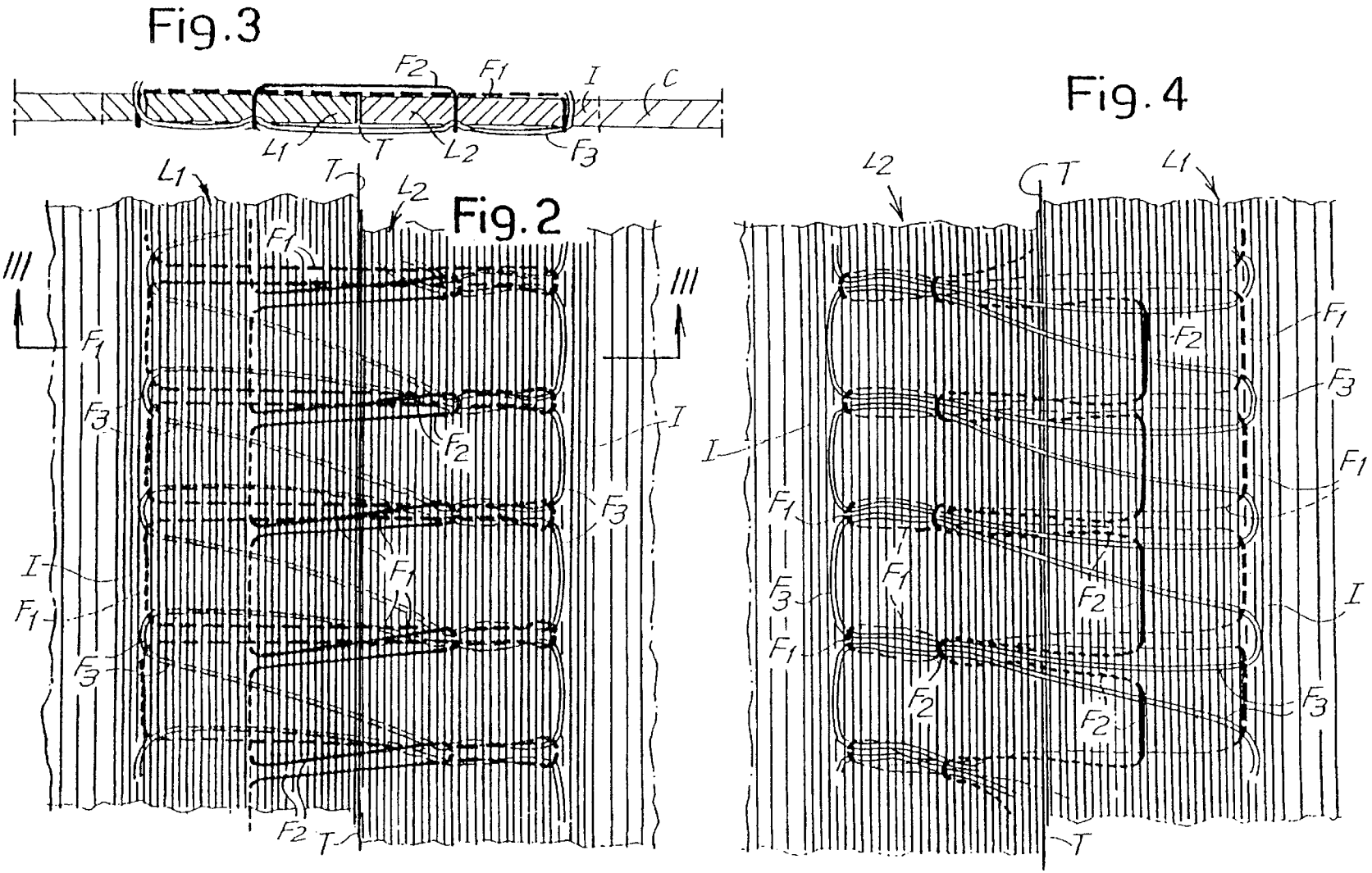
FIGS. 2, 3 and 4 show an enlarged detail of the area indicated by the arrow fII, a cross section on III—III as marked in FIG. 2 and an enlarged view of a detail indicated by the arrow fIV marked in FIG. 1, so as to define the structure of the flat seam.

As shown in the accompanying drawing, with initial reference to the FIGS. 1 to 4, an article according to the invention is shown with so-called "flatlock" seams of loose, flat stitches, which are used to close the toes P and to connect the two components, each of which consists of a leg G and a portion of the body section C, along the crotch, with the possible addition of a gusset T. The toe seam is marked CP, while the seam along the crotch line is given the general reference CC and is shown in greater detail in FIGS. 2 to 4. In the seam area the fabric of the two pieces L1 and L2, which are sewn together, can optionally be formed by two portions of non-run fabric marked I, while further away, the fabric of the article can be made with a normal knit and is therefore more elastic and more suited to the function of the article, using techniques known per se; the non-run portions I along the pieces L1 and L2 that are to be sewn give the knitted stitches greater resistance to unravelling.

The so-called flatlock seam described above is particularly effective because under the conditions of tension of the fabric when the article is worn, the two pieces L1 and L2—which are connected by the seams such as CP and such as CC formed by threads F1, F2 and F3—are basically brought edge-to-edge along the lines of the cut T with no overlap and especially without that cord-like bunching up of the fabrics which is present in the conventional structure of seams produced by overlock machines. The seam can be produced in such a way that the stitches formed by threads F1 and F2 lie primarily on the outside while the stitches formed by thread F3 of the chain-stitch seam produced with the thread fed to the looper are on the inside of the article when worn. However, the possibility of choosing the reverse position of that indicated is not excluded.

Essential considerations in the seam that is to be produced are what strength is desired and how much stretch capacity is required of the two pieces L1, L2 sewn together, which stretch is produced by increasing the length of the long stitches and short stitches (with threads F1 and F2) and likewise the chain-stitch seam (with thread F3).

The seam described above can be produced industrially on—for example, but not necessarily—conventional-type overlock machines such as those produced by Union Special, Yamato, Juki, Rimoldi, etc., by fitting these machines with the equipment described in the application for an industrial utility model which the present Applicant is filing simultaneously with the present application; in which case the seam will be made by threading the overlock machining with two needle threads (the two needle threads F1 and F2) and one lopper thread F3; thread F1 will make the long stitches, while thread F2 will make short stitches positioned in an intermediate position relative to the position occupied by the long stitches formed by thread F1, while the third thread F3 will be fed to a looper and will form the chain stitches, which are particularly visible on the opposite side to that on which the long stitches of thread F1 and short stitches of thread F2 can be seen. The long stitches and short stitches of threads F1 and F2 respectively are particularly visible in FIG. 2, while the looper stitches, the so-called chain stitches, formed by thread F3 are visible mostly in FIG. 4. Thread F1 intended to form the long stitches is fed to the needle that passes through the pieces L1 and L2 at the furthest position from the line of the cut T, while thread F2 is fed to the needle closest to the line of the cut T.

What is claimed is:

1. A panty-hose article made from sheer knit fabric, the article comprising: seams for joining together, along a crotch, constituent pieces (L1, L2) of fabric, the seam including three series of stitches, namely:

a) a first series of short stitches, formed with a needle thread (F2), which extend across a "cut line" (T), passing out of one of the two pieces (L1, L2) of fabric being joined together and entering the other at positions relatively near to the cut line (T);

b) a second series of longer stitches, formed with a needle thread (F1), which stitches extend across the cut line (T), passing out of one of the two pieces of fabric being assembled and entering the other at a greater distance from the cut line (T) than the first series of stitches, so that the shorter stitches of the first series of stitches lie inside the longer stitches of the second series of stitches; and c) a third series of stitches, formed with "slack" stitches of a looper thread (F3), much longer and "slacker" than those of the first two series of stitches, which stitches of the third series form a "chain" seam, extending across the cut line (T) and forming chain stitches with the first two threads (F1, F2); when the pieces of fabric joined by said seam are tensioned and made coplanar, margins of the fabric connected by said seam are "adjacent" and "juxtaposed" so that the seam is thinner than the seam is wide.

2. A panty-hose article comprising:

a first leg with a first body section having a first body edge;

a second leg with a second body section having a second body edge, said second body edge and said first body edge being arranged adjacent each other, said first and second body edges defining a cut line between each other;

a seam joining said first and second body edges, said seam having a stitch arrangement for holding said first and second body edges substantially coplanar when said first and second body edges are stretched apart, said stitching arrangement causing said seam to have a thickness significantly less than a width of said seam, said stitch arrangement includes:

a) a first series of stitches formed with a first needle thread extending across said cut line, said first needle thread passing in and out of said first and second body sections at first positions;

b) a second series of stitches formed with a second needle thread extending across said cut line, said second needle thread passing in and out of said first and second body sections at second positions, said second positions being spaced further from said cut line than said first positions to cause said first series of stitches to lie inside said second series of stitches;

c) a third series of stitches formed with slack stitches of a looper thread, said third series of stitches being longer and slacker than said first and second series of stitches, said third series of stitches form a chain seam extending across said cut line and forming chain stitches with said first and second threads.

3. The panty-hose article in accordance with claim 2, wherein:

said stitches arrangement holds said first and second body edges adjacent and juxtaposed when said first and second body sections are tensioned so that said seam is thinner than said seam is wide.

4. The panty-hose article in accordance with claim 2, wherein:

said stitch arrangement holds said first and second body edges adjacent and juxtaposed when said first and second body sections are tensioned so that said seam is thinner than said seam is wide.

* * * * *